US009342037B2

(12) United States Patent
Namba et al.

(10) Patent No.: US 9,342,037 B2
(45) **Date of Patent: *May 17, 2016**

(54) IMAGE FORMING APPARATUS

(71) Applicants: Masanori Namba, Kanagawa (JP); Toshikane Nishii, Osaka (JP); Mitsutaka Nakamura, Hyogo (JP); Haruyuki Honda, Kanagawa (JP)

(72) Inventors: Masanori Namba, Kanagawa (JP); Toshikane Nishii, Osaka (JP); Mitsutaka Nakamura, Hyogo (JP); Haruyuki Honda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/673,208

(22) Filed: Mar. 30, 2015

(65) Prior Publication Data

US 2015/0205252 A1 Jul. 23, 2015

Related U.S. Application Data

(63) Continuation of application No. 14/180,860, filed on Feb. 14, 2014, now Pat. No. 9,025,991.

(30) Foreign Application Priority Data

Feb. 18, 2013 (JP) ..... 2013-028926

(51) Int. Cl.
*G03G 21/20* (2006.01)
*G03G 21/16* (2006.01)

(52) U.S. Cl.
CPC ..... *G03G 21/1623* (2013.01); *G03G 21/203* (2013.01)

(58) Field of Classification Search
USPC ..... 399/91–97, 107, 110, 111, 114
See application file for complete search history.

(56) References Cited

U.S. PATENT DOCUMENTS

| | | | | |
|---|---|---|---|---|
| 4,645,327 | A | 2/1987 | Kimura et al. | |
| 5,223,902 | A | 6/1993 | Chodak et al. | |
| 5,832,341 | A | 11/1998 | Facci et al. | |
| 6,049,680 | A * | 4/2000 | Goris | G03G 15/1695 399/44 |
| 8,165,490 | B2 | 4/2012 | Yamazoe | |
| 9,008,535 | B2 * | 4/2015 | Wakayama | G03G 21/203 399/97 |
| 9,025,991 | B2 * | 5/2015 | Namba | G03G 21/1623 399/114 |
| 2013/0004221 | A1 | 1/2013 | Honda et al. | |

FOREIGN PATENT DOCUMENTS

| | | | |
|---|---|---|---|
| JP | H03100688 | A | 4/1991 |
| JP | H0627844 | A | 2/1994 |
| JP | H0844274 | A | 2/1996 |
| JP | H11296008 | A | 10/1999 |
| JP | 2000089594 | A | 3/2000 |
| JP | 2006276215 | A | 10/2006 |
| JP | 2008209854 | A | 9/2008 |
| JP | 2011059483 | A | 3/2011 |
| JP | 5035135 | B2 | 9/2012 |

* cited by examiner

*Primary Examiner* — Hoan Tran
(74) *Attorney, Agent, or Firm* — Harness, Dickey & Pierce, P.L.C.

(57) ABSTRACT

An image forming apparatus includes an apparatus body, a manual operating unit, at least a part of which being exposed to an outside of the apparatus body and a part of which included inside the apparatus body being exposed to the outside by manually operating from the outside, a condensation part to which moist air in the apparatus body contacts to dew-condense to a water droplet, and a recovery container part containing the water droplet generated by the condensation part and being disposed on an inner surface of the manual operating unit included inside the apparatus body.

19 Claims, 11 Drawing Sheets

IMAGE FORMING APPARATUS

CROSS-REFERENCE TO RELATED APPLICATIONS

This patent application is a continuation of U.S. application Ser. No. 14/180,860, filed on Feb. 14, 2014, which is based on and claims priority pursuant to 35 U.S.C. §119 to Japanese Patent Application No. 2013-028926, filed on Feb. 18, 2013 in the Japan Patent Office, the entire disclosure of each of which is hereby incorporated by reference herein.

BACKGROUND

1. Technical Field

Embodiments of the present invention relate to an image forming apparatus functioning as a copier, a printer, a facsimile machine, or a multifunctional system having at least two features of the copier, the printer, and the facsimile machine.

2. Related Art

A fixing unit of a heat and pressure application method is employed to image forming apparatuses. The fixing unit fixes a toner image to a recording medium conveyed to a fixing nip area provided therein by heating and fusing the toner image held on the recording medium with application of heat and pressure.

However, in the fixing unit during this fixing operation, moisture contained in the recording medium evaporates due to heat application. Heated steam dew-condenses on a conveying guide and/or a conveying roller, which produces water droplet. In this case, the water droplet can adhere to the recording medium. For example, if the stream generated by the fixing unit dew-condenses on the conveying guide disposed above the fixing unit, when a duplex printing is performed, the water droplet produced by dew-condensation on the conveying guide adheres to the recording medium. Consequently, the water droplet disorders a toner image to be transferred onto the back side of the recording medium, resulting in image formation failure such as a total or partial loss of image data.

To address this problem, typical image forming apparatuses include a condensation occurrence part to intentionally condense steam generated in the image forming apparatus. The condensation occurrence part is disposed at a position different from a sheet conveying path to collect water droplet produced in the condensation occurrence part to a recovery container.

For example, Japanese Patent Application Publication No. JP-2011-059483-A discloses a configuration including a condensation member to positively dew-condense moisture in the air and a recovery container to collect or recover water droplet produced with the condensation member in an adjacent area to a conveying path through which a recording medium is conveyed. The condensation member has a slope on which the condensed water droplet moves along with an aid of gravity in a direction to separate from the conveying path, so that the slope guides the water droplet to the recovery container.

Japanese Patent Application Publication No. JP-H05-035153-A discloses a configuration including a cover that is disposed in a slanted manner. The slanted cover guides water droplet produced by dew-condensation on an inner surface of a cover of a fixing unit to a water droplet recovery portion (a recessed part) formed on the cover.

Japanese Patent Application Publication No. JP-H11-296008-A discloses a configuration including a frame that covers a fixing unit from above. The frame is provided with a film thereon to condense steam or moisture, and also with a dent or a recessed part thereon to store or contain water droplet that falls from the film.

Japanese Patent No. JP-2664313-B (JP-H06-027844-A) discloses a configuration including a partition frame having a slanted surface and being disposed above a fixing and conveying device. The slanted surface of the partition guides water droplet to a recovery container (a recessed part) of a water droplet recovery member to recover and store the water droplet therein. The water droplet recovery member is detachably attached to a fixing unit housing, so that the recover container can be cleaned.

As described above, with the configuration in which steam is dew-condensed in an image forming apparatus and water droplet produced by dew-condensation is stored in a recovery container, it is preferable that the water droplet contained in the recovery container is removed to avoid spilling from the recovery container when the recovery container is in a full state.

However, in the above-described configurations, it is difficult or bothersome for users or operators to remove the water droplet from the recovery container and perform maintenance work such as checking the state of the recovery container from outside the image forming apparatus.

SUMMARY

At least one embodiment of the present invention provides an image forming apparatus including an apparatus body, a manual operating unit, at least a part of which being exposed to an outside of the apparatus body and a part of which included inside the apparatus body being exposed to the outside by manually operating from the outside, a condensation part to which moist air in the apparatus body contacts to dew-condense to a water droplet, and a recovery container part to contain the water droplet generated by the condensation part and be disposed on an inner surface of the manual operating unit included inside the apparatus body.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
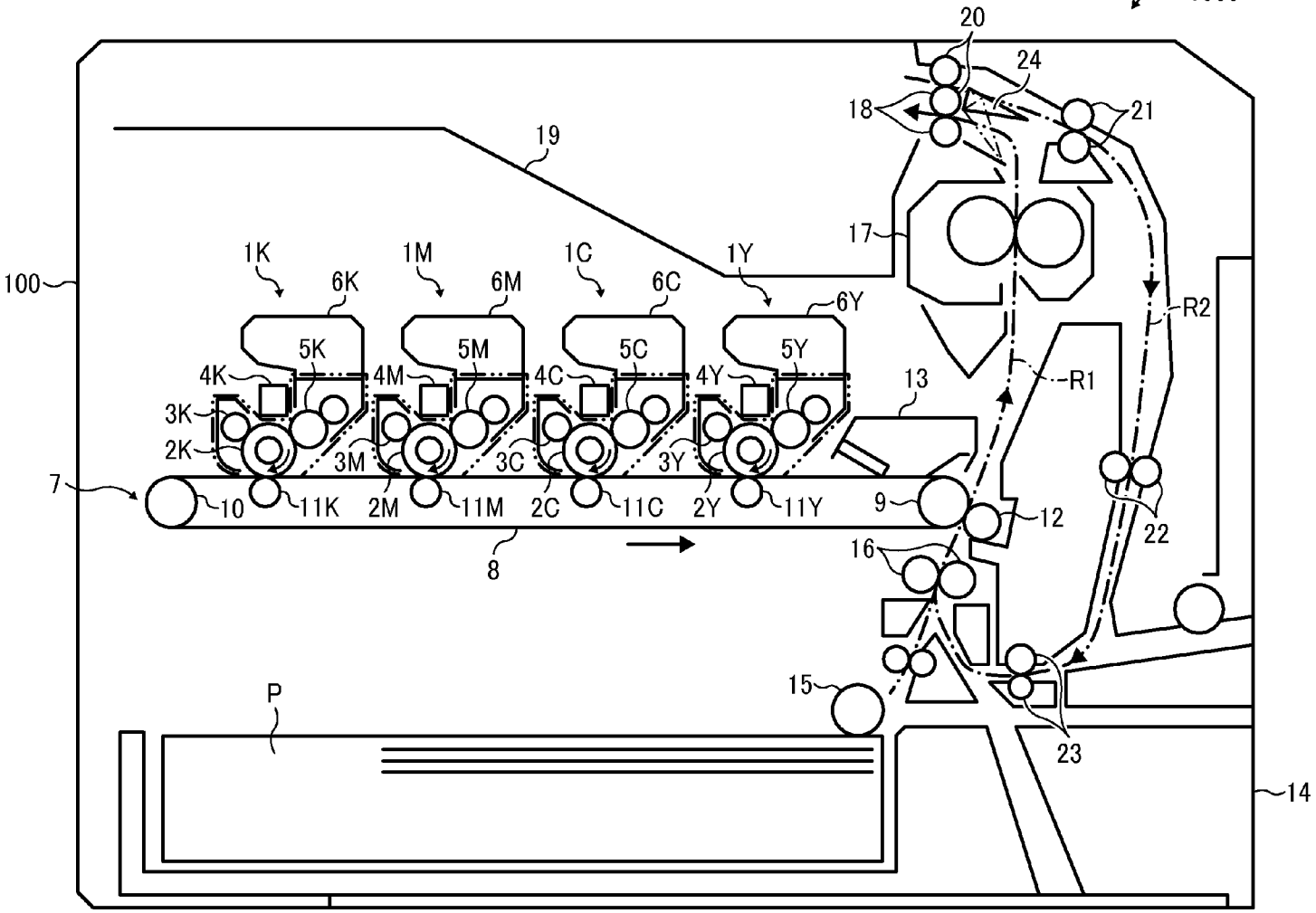
FIG. 1 is a cross-sectional view illustrating a schematic configuration of an image forming apparatus according to Embodiment 1 of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

FIG. 1 illustrates a schematic configuration of an image forming apparatus 1000 according to Embodiment 1 of the present invention.

The image forming apparatus 1000 may be a copier, a facsimile machine, a printer, a multifunction peripheral or a multifunction printer (MFP) having at least one of copying, printing, scanning, facsimile, and plotter functions, or the like. According to Embodiment 1, the image forming apparatus 1000 is an electrophotographic color laser printer that forms color and monochrome toner images on recording media by electrophotography.

Now, a description is given of the entire configuration and functions of the image forming apparatus 1000 according to Embodiment 1.

As illustrated in FIG. 1, the image forming apparatus 1000 includes an apparatus body 100. The apparatus body 100 includes four image forming units 1Y, 1C, 1M, and 1K disposed at the center part of the apparatus body 100. The image forming units 1Y, 1C, 1M, and 1K form respective single color images of yellow (Y), cyan (C), magenta (M), and black (K), which are different from each other corresponding to color separation of a color image. Elements and components of the image forming units 1Y, 1C, 1M, and 1K are similar in structure and functions, except that the respective single colors are different from each other.

Hereinafter, the image forming units 1Y, 1C, 1M, and 1K are also referred to as the image forming unit(s) 1.

The image forming unit 1 includes a photoconductor 2 (i.e., photoconductors 2Y, 2C, 2M, and 2K), a charger 3 (i.e., chargers 3Y, 3C, 3M, and 3K), an exposure unit 4 (i.e., exposure units 4Y, 4C, 4M, and 4K), a development unit 5 (i.e., development units 5Y, 5C, 5M, and 5K), and a toner cartridge 6 (i.e., toner cartridges 6Y, 6C, 6M, and 6K). The photoconductor 2 functions as an image carrier. The charger 3 uniformly charges a surface of the photoconductor 2. The exposure unit 4 forms an electrostatic latent image on the charged surface of the photoconductor 2. The development unit 5 supplies toner to the electrostatic latent image formed on the photoconductor 2 to develop into a visible toner image. The toner cartridge 6 contains toner to be supplied to the development unit 5. In Embodiment 1, the photoconductor 2, the charger 3, and the development unit 5 are integrally provided as a process unit that is detachably attachable to the apparatus body 100.

A transfer unit 7 is disposed below the image forming units 1Y, 1C, 1M, and 1K. The transfer unit 7 transfers the toner image onto a recording medium. The transfer unit 7 includes an intermediate transfer belt 8, a primary roller 11 (i.e., primary rollers 11Y, 11C, 11M, and 11K), and a secondary roller 12. The intermediate transfer belt 8 is a loop shaped body functioning as an intermediate transfer member. The primary roller 11 functions as a primary transfer member and the secondary roller 12 functions as a secondary transfer member.

The intermediate transfer belt 8 is spanned around multiple rollers 9 and 10. By driving one of the multiple rollers 9 and 10 to rotate, the intermediate transfer belt 8 endlessly rotates in a direction indicated by arrow in FIG. 1.

The four primary rollers 11Y, 11C, 11M, and 11K are disposed facing the photoconductors 2Y, 2C, 2M, and 2K of the image forming units 1Y, 1C, 1M, and 1K, respectively. The primary roller 11 contacts or presses an inner circumferential surface of the intermediate transfer belt 8 at a position facing the photoconductor 2 of the image forming unit 1 where a primary transfer nip area is formed. The primary roller 11 is connected to a power source, so that a given amount of a direct current voltage (DC) and/or an alternating current voltage (AC) is applied to the primary roller 11.

The secondary roller 12 contacts or presses an outer circumferential surface of the intermediate transfer belt 8 at a position facing one of multiple rollers supporting the intermediate transfer belt 8 (i.e., the roller 9 in FIG. 1) where a secondary transfer nip area is formed. Similar to the primary roller 11, the secondary roller 12 is connected to the power source, so that a given amount of a direct current voltage (DC) and/or an alternating current voltage (AC) is applied to the secondary roller 12.

A belt cleaning unit 13 is disposed on the outer circumferential surface of the intermediate transfer belt 8 to clean the surface of the intermediate transfer belt 8.

At a lower part of the apparatus body 100, a sheet container 14 and a feed roller 15 are provided. The sheet container 14 functions as a recording media container to contain a stack of recording media including a recording medium P. The feed roller 15 feeds the recording medium P from the sheet container 14. The recording medium P represents a thick paper, a postcard, an envelope, a regular paper, a thin paper, a coated paper, an art paper, a tracing paper, an overhead projector (OHP) sheet, and an OHP film.

A sheet conveying path R1 is provided in the apparatus body 100 to convey the recording medium P fed from the sheet container 14 via the feed roller 15.

A registration roller pair 16 and a fixing unit 17 are disposed along the sheet conveying path R1. The registration roller pair 16 functions as a timing roller pair to convey the recording medium P to the secondary transfer nip area at an appropriate conveying time. The fixing unit 17 fixes an unfused image transferred onto the recording medium P to the recording medium P.

A sheet discharging roller pair 18 is disposed at the end of the sheet conveying path R1 to discharge the recording medium P outside the apparatus body 100 of the image forming apparatus 1000.

A sheet discharging tray 19 is provided on top of the apparatus body 100 to stack the discharged recording medium P thereon.

The image forming apparatus 1000 according to Embodiment 1 includes a sheet reverse conveying unit to reverse the recording medium P for duplex printing and convey the reversed recording medium P. Specifically, the sheet reverse conveying unit includes a sheet reverse roller pair 20 and multiple conveying roller pairs 21, 22, and 23. The sheet reverse roller pair 20 conveys the recording medium P in a reverse direction that is opposite to the sheet conveying direction to a reverse path R2. The multiple conveying roller pairs 21, 22, and 23 convey the recording medium P in the reverse path R2. In Embodiment 1, one of the sheet discharging roller pair 18 is used as one of the sheet reverse roller pair 20.

A separator 24 is disposed downstream from the fixing unit 17 in the sheet conveying direction to change the sheet conveying path of the recording medium P. Pivoting the separator 24 selectively determines whether the recording medium P is conveyed toward the sheet discharging roller pair or toward the sheet reverse roller pair 20.

Next, a description is given of a series of image forming operations performed by the image forming apparatus 1000 according to Embodiment 1, with reference to FIG. 1.

When the image forming operations start, a drive unit rotates the photoconductors 2 of the image forming units 1 clockwise in FIG. 1, so that the charger 3 uniformly charges the respective surfaces of the photoconductors 2 to a given polarity. Based on image data transmitted from an image reading device or an external computer, the exposure unit 4 emits light to irradiate the charged surfaces of the photoconductors 2, so as to form respective electrostatic latent images thereon. At this time, image data to be exposed to the respective surfaces of the photoconductors 2 are respective single color images of a full color image separated into each color data of yellow, cyan, magenta, and black. The development units 5 supply respective color toners to the electrostatic latent images on the respective surfaces of the photoconductors 2. With this action, the electrostatic latent images are developed into respective visible toner images.

At the same time the image forming operations start, the intermediate transfer belt 8 is rotated in a direction indicated by arrow in FIG. 1. Due to application of a constant voltage that has an opposite polarity to a toner charge polarity or a constant current control voltage, a transfer electric field is generated in the primary nip area.

Thereafter, as the photoconductors 2 rotate, when the respective single color toner images formed on the photoconductors 2 reach the respective primary transfer nip areas, the transfer electric fields formed in the respective primary transfer nip areas cause the toner images on the photoconductors 2 to be sequentially transferred and overlaid onto the intermediate transfer belt 8. Thus, a full color toner image is formed on the surface of the intermediate transfer belt 8.

At the lower part of the apparatus body 100, the feed roller 15 rotates to feed the recording medium P from the sheet container 14 to the sheet conveying path R1. The recording medium P in the sheet conveying path R1 is stopped temporarily by the registration roller pair 16.

Then, the registration roller pair 16 resumes its rotation after a given time has elapsed. In synchronization with movement of the toner image on the intermediate transfer belt 8 to arrive the secondary transfer nip area, the recording medium P is conveyed to the secondary transfer nip area. At this time, a transfer voltage having a polarity opposite to the toner charge polarity of the toner image held on the intermediate transfer belt 8 is applied to the secondary roller 12. Consequently, a transfer electric field is generated in the secondary transfer nip area. With the aid of the transfer electric field, the toner image on the intermediate transfer belt 8 is transferred onto the recording medium P.

The belt cleaning unit 13 removes residual toner remaining on the surface of the intermediate transfer belt 8 without being transferred onto the recording medium P.

The recording medium P is then conveyed to the fixing unit 17. In the fixing unit 17, the toner image held on the recording medium P is fixed to the recording medium P. Then, the separator 24 disposed as illustrated with a solid line in FIG. 1 guides recording medium P to the discharging roller pair 18 to be discharged therethrough to the sheet discharging tray 19.

When a duplex printing is performed, the separator 24 is moved to a position illustrated with a dashed line in FIG. 1 to guide the recording medium P having the toner image on a front surface (one side) thereof to the sheet reverse roller pair 20. With the timing the trailing edge of the recording medium P has not completely passed through the sheet reverse roller pair 20, the sheet reverse roller pair 20 is rotated to convey the recording medium P to the reverse path R2.

The recording medium P that is sent to the reverse path R2 is conveyed by the multiple conveying roller pairs 21, 22, and 23 to the sheet conveying path R1 again. Thereafter, similar to a single side printing, a toner image is transferred onto and fixed to a rear side of the recording medium P. Then, the separator 24 that has been changed to the position illustrated with the solid line in FIG. 1 guides the recording medium P to the sheet discharging roller pair 18 to discharge the recording medium to the sheet discharging tray 19.

The above-described image forming operations are to form a full color image on a recording medium. However, a monochrome image can be formed using any one of the image forming units 1Y, 1C, 1M, and 1K or a two- or three-color image can be formed using two or three of the image forming units 1Y, 1C, 1M, and 1K.

Figure 2:
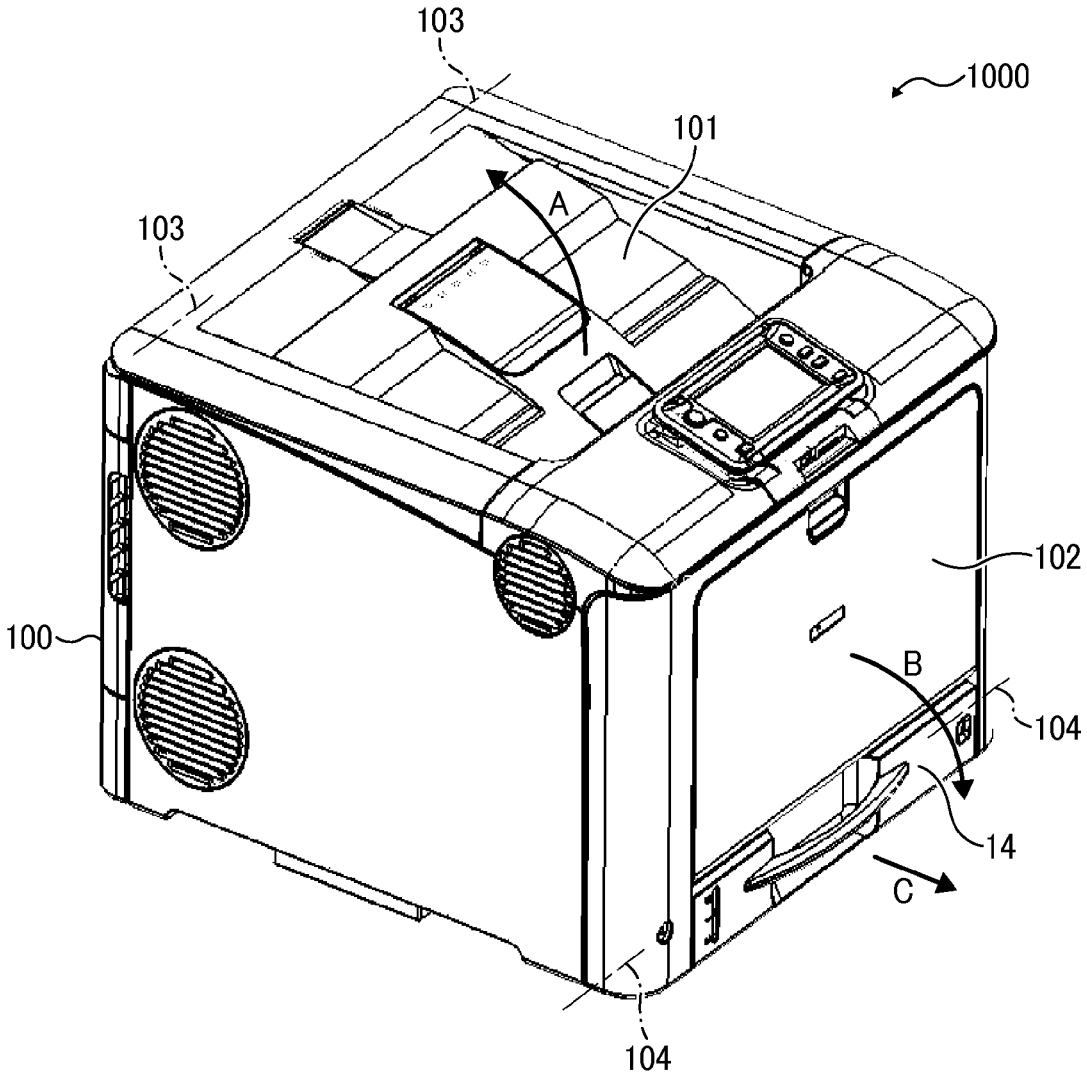
FIG. 2 is a perspective view illustrating an external appearance of the image forming apparatus of FIG. 1.

FIG. 2 is a perspective view illustrating an external appearance of the image forming apparatus 1000 according to Embodiment 1.

As illustrated in FIG. 2, the image forming apparatus 1000 includes two types of cover units. Specifically, a top cover 101 and a front cover 102 are attached openably closed to the apparatus body 100. The top cover 101 is provided on top of the apparatus body 100 and the front cover 102 that functions as a manual operating unit is provided to a front side of the apparatus body 100 of the image forming apparatus 1000.

The top cover 101 is pivotably disposed about a rotation shaft 103 extending in a horizontal direction at an upper part of the top cover 101 connected to an upper rear part of the apparatus body 100. By pivoting the top cover 101 about the rotation shaft 103 in a direction indicated by arrow A in FIG. 2, an upper portion of the apparatus body 100 can be opened, thereby removing and replacing process units and toner cartridges easily.

The front cover 102 is pivotably disposed about a rotation shaft 104 extending in the horizontal direction at a lower part thereof connected to a lower front part of the apparatus body 100. By pivoting the front cover 102 about the rotation shaft 104 in a direction indicated by arrow B in FIG. 2, a front portion of the apparatus body 100 can be opened, thereby removing jammed sheet in paper jam.

The sheet container 14 that is disposed at the lower portion of the apparatus body 100 can slidably move in the horizontal direction to be detachably attached to the apparatus body 100. By removing the sheet container 14 from the apparatus body 100 in a direction indicated by arrow C, recording media can be replenished into the sheet container 14.

Figure 3:
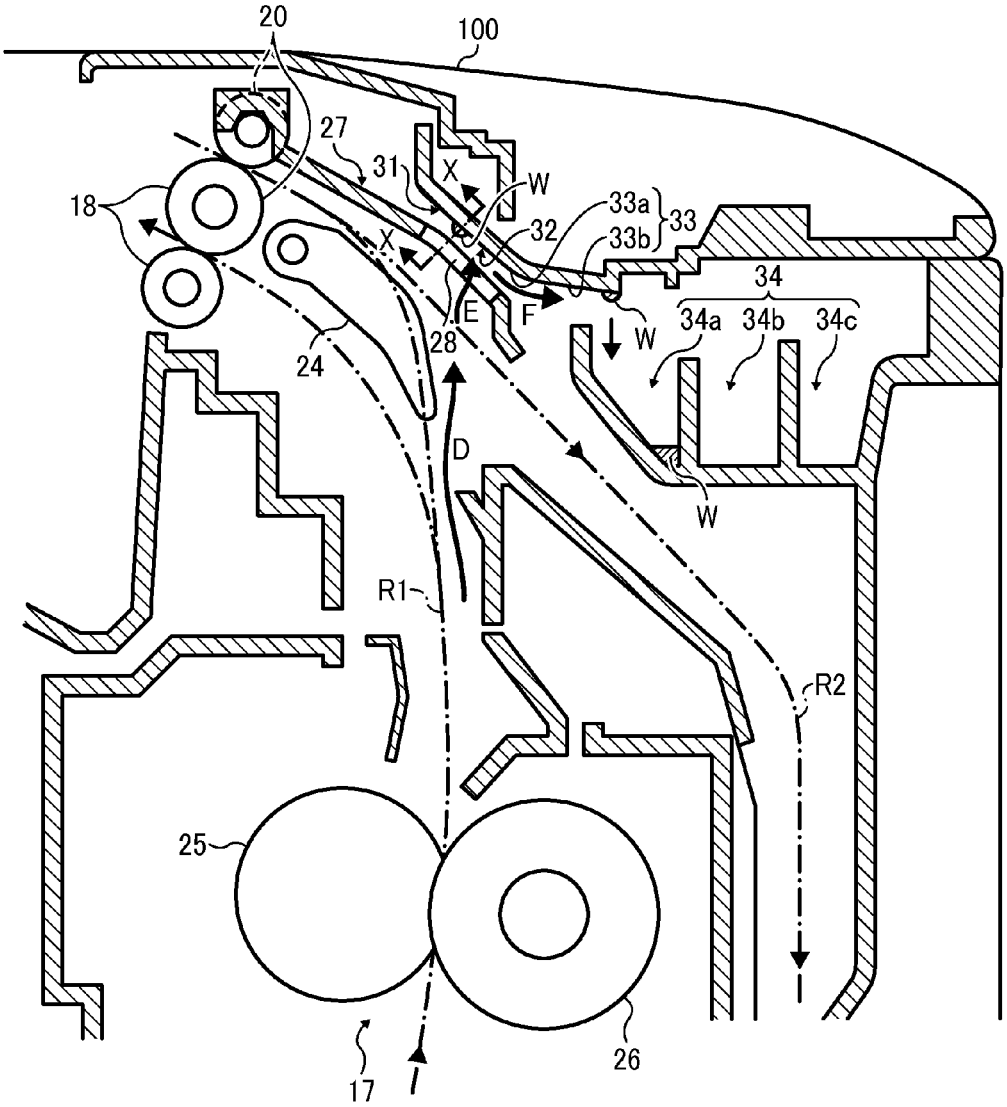
FIG. 3 is a cross-sectional view illustrating a front upper part of the image forming apparatus of FIG. 1.

FIG. 3 is a schematic cross-sectional view illustrating a front upper part of the image forming apparatus 1000 according to Embodiment 1.

As illustrated in FIG. 3, the fixing unit 17 is disposed at the front side of the upper part of the apparatus body 100. This fixing unit 17 employs a heat and pressure application method and includes a fixing body 25 to be heated by a heat source such as a heater, and a pressure body 26 to be pressed by the fixing body 25. Therefore, when the fixing unit 17 fixes an unfused image held on the recording medium P to the recording medium P, moisture included in the recording medium P evaporates by heat applied by the fixing unit 17 to generate steam. In Embodiment 1, the steam generated in the fixing unit 17 moves upward as indicated by arrow D in FIG. 3. A duplex sheet conveying guide 27 that functions as a recording medium conveying guide is disposed inside the apparatus body 100 at a destination of the steam to guide the recording medium P in the duplex printing operation. Therefore, in a case in which the steam dew-condenses on the duplex sheet conveying guide 27, it is likely that water droplet produced on the duplex sheet conveying guide 27 attaches to the duplex printing operation.

In Embodiment 1, to reduce generation of water droplet as a result of dew-condensation on the duplex sheet conveying guide 27, the duplex sheet conveying guide 27 includes a slit-shaped through-opening 28 that penetrates therethrough from the guide side surface (the lower surface) of the duplex sheet conveying guide 27 to the back surface (the upper surface) thereof. Thus, by providing the through-opening 28 to the duplex sheet conveying guide 27, the steam can be discharged upward in a direction indicated by arrow E in FIG. 3 via the through-opening 28. As a result, dew-condensation onto the guide surface side of the duplex sheet conveying guide 27 can be reduced.

Figure 4:
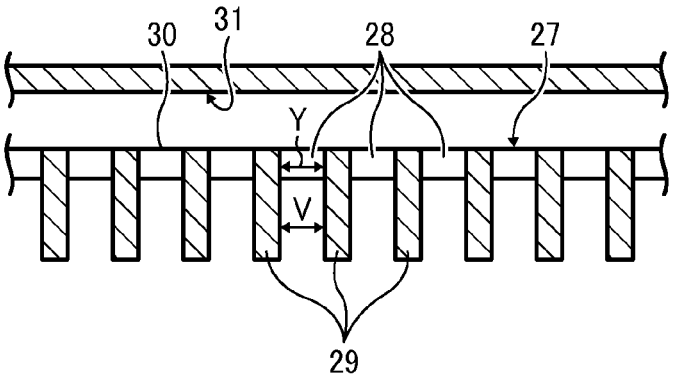
FIG. 4 is a cross-sectional view illustrating the front upper part of the image forming apparatus along a line X-X of FIG. 3.

FIG. 4 is a cross-sectional view of the image forming apparatus 1000, viewed along with an X-X line in FIG. 3.

As illustrated in FIG. 4, the duplex sheet conveying guide 27 further includes a planar guide plate 30 and multiple ribs 29. The multiple ribs 29 protrude toward the guide side surface of the guide plate 30. The multiple ribs 29 are aligned along a direction perpendicular to the sheet conveying direction, which is a left-to-right direction in FIG. 4, so that the through-opening 28 extends between the multiple ribs 29 in the sheet conveying direction. In Embodiment 1, a width Y of the through-opening 28 is formed to be the same or the substantially same as an interval V between the multiple ribs 29. By thus forming the through-opening 28, little surfaces between the multiple ribs 29 of the guide plate 30 are exposed, and therefore occurrence of dew-condensation on the guide plate 30 can be highly prevented.

Further, as illustrated in FIG. 3, a condensation part 31 is provided on the back side surface (the guide side surface or an upper side surface) of the duplex sheet conveying guide 27 to dew-condense moist air or steam to water droplet W in the apparatus body 100 of the image forming apparatus 1000. That is, when moist air contacts the condensation part 31, dew-condensation occurs thereon to produce the water droplet W. The condensation part 31 is a planar plate member disposed facing the back surface of the duplex sheet conveying guide 27 with a gap or clearance therebetween.

As described above, by providing the condensation part 31 on the back side of the duplex sheet conveying guide 27, the steam that has passed through the through-opening 28 of the duplex sheet conveying guide 27 contacts the condensation part 31 to be dew-condensed to produce the water droplet W.

It is to be noted that steam to dew-condense on the condensation part 31 is not limited to the steam generated in the fixing unit 17. For example, steam or moist air in the apparatus body 100 can be applied to dew-condensation.

Further, a guide 32 is disposed on the side of the back side surface (the upper side surface) of the duplex sheet conveying guide 27 to guide the water droplet W produced on the condensation part 31 to a given direction. Specifically, the guide 32 has a sloped surface part 33 that slopes down from the condensation part 31 to the front side of the apparatus body 100. The sloped surface part 33 has two sloped surfaces 33*a* and 33*b* having respective angles of inclination different from each other. Specifically, the sloped surface part 33 has a first sloped surface 33*a* and a second sloped surface 33*b*. The first sloped surface 33*a* is formed on an upper part thereof and has an angle of inclination with respect to a horizontal direction. The second sloped surface 33*b* is formed on a lower part thereof and has a smaller angle of inclination than the first sloped surface 33*a* with respect to the horizontal direction.

By including the guide 32 having the above-described structure, the water droplet W produced on the condensation part 31 is guided with the aid of gravity along the sloped surface part 33 in a direction indicated by arrow F in FIG. 3.

A recovery container part 34 is disposed below a portion to which the water droplet W is guided (below a lower end of the sloped surface part 33) to store or contain the guided water droplet W. The recovery container part 34 has a recess shape having a top opening so as to receive the water droplet W that falls from the end portion of the guide 32 (the lower end of the sloped surface part 33).

Figure 5:
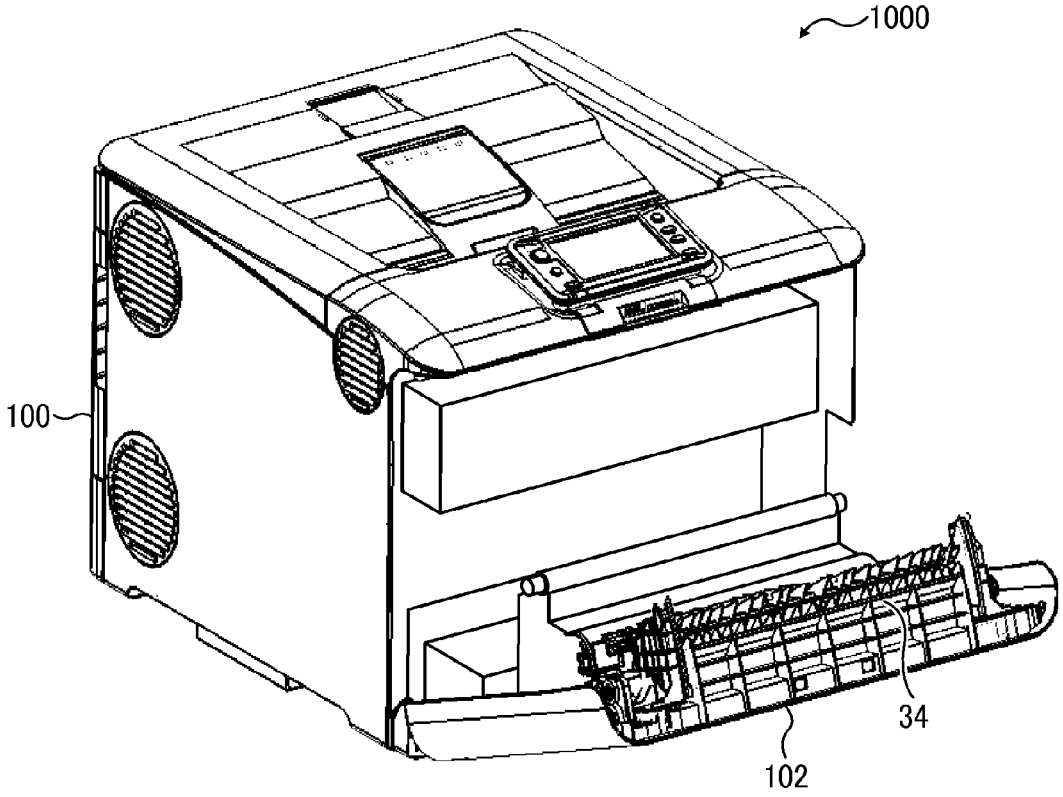
FIG. 5 is a perspective view illustrating an external appearance of the image forming apparatus with a front cover opened.
Figure 6:
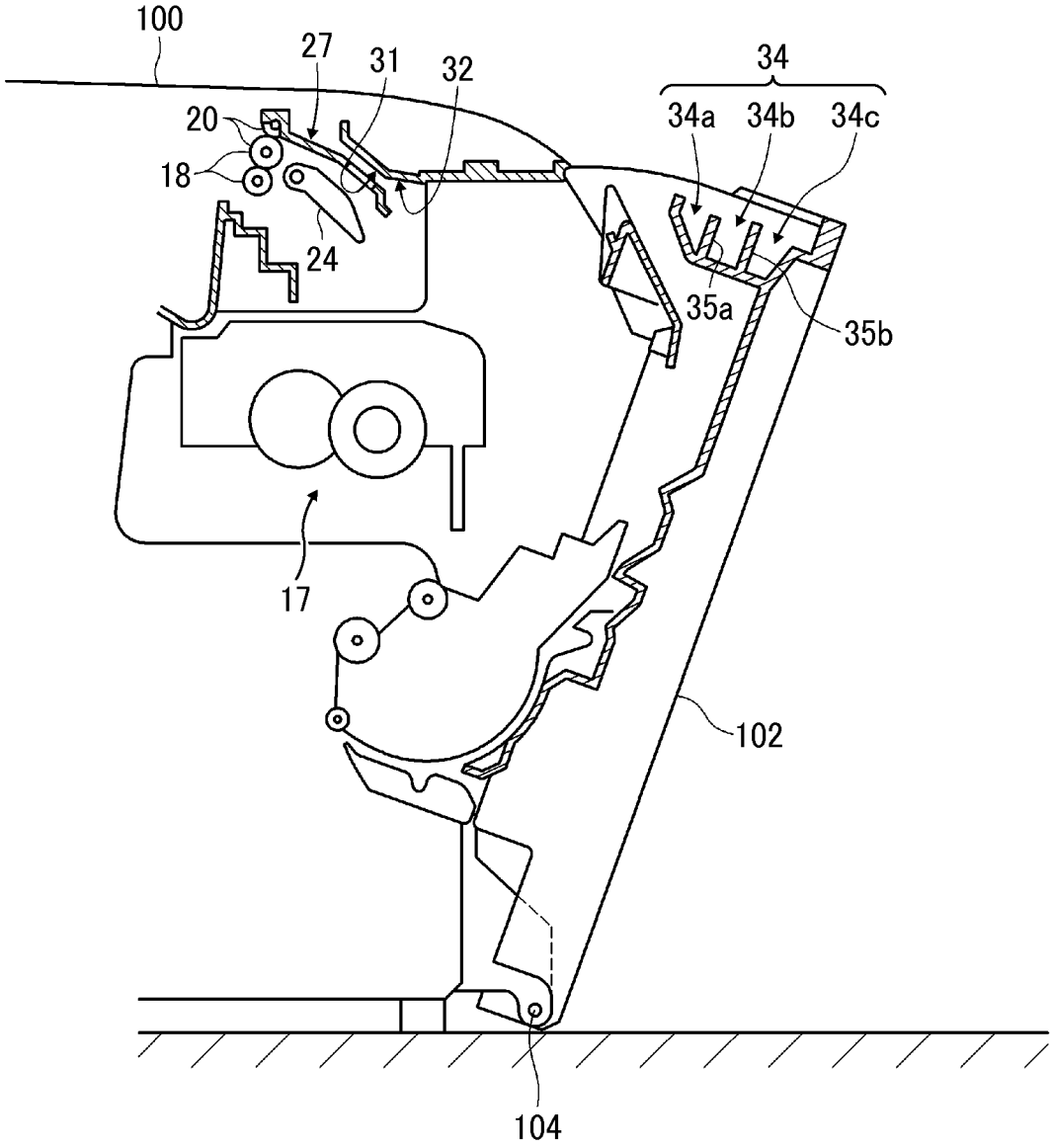
FIG. 6 is a cross-sectional view illustrating the image forming apparatus with the front cover opened at a given angle.
Figure 7:
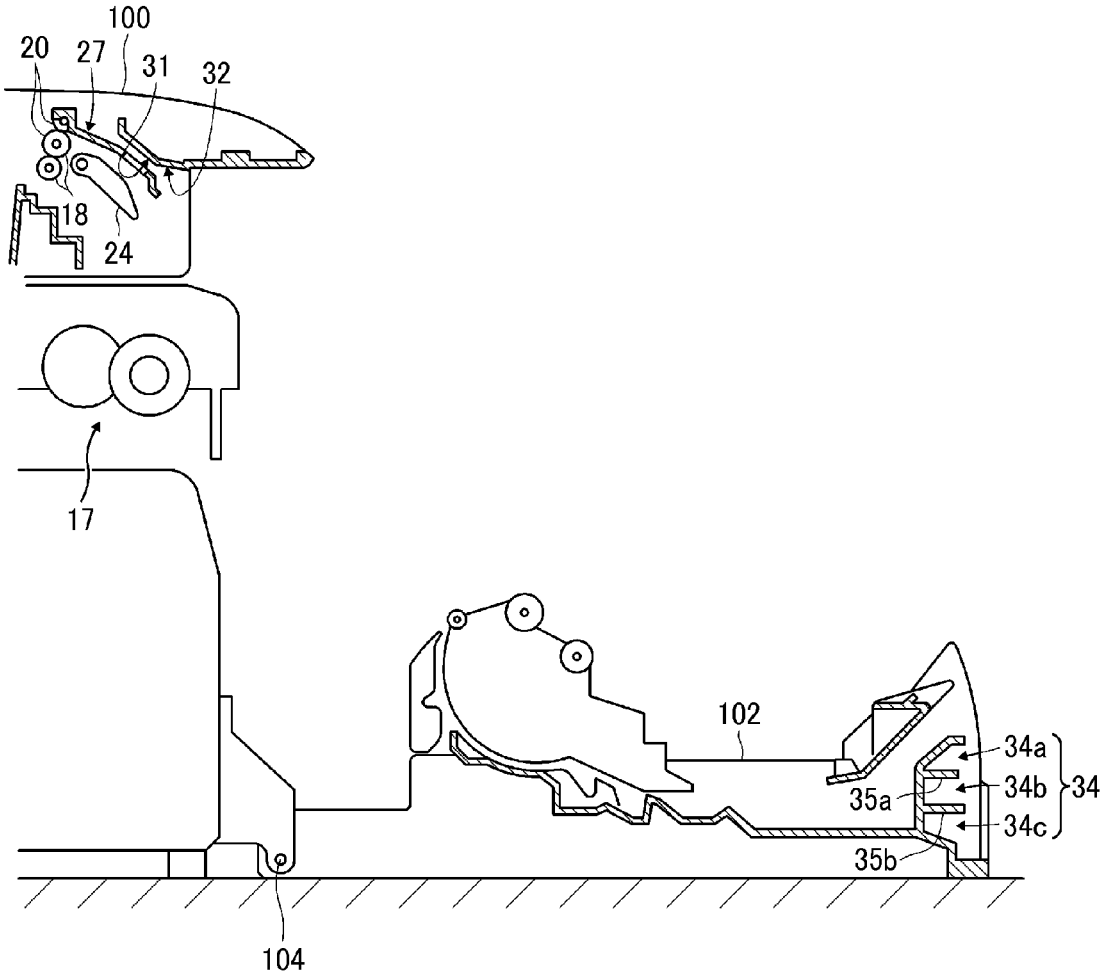
FIG. 7 is a cross-sectional view illustrating the image forming apparatus with the front cover fully opened.

FIG. 5 is a perspective view illustrating an external appearance of the image forming apparatus 1000 with the front cover 102 opened. FIG. 6 is a cross-sectional view illustrating the image forming apparatus 1000 with the front cover 102 opened at a certain angle. FIG. 7 is a cross-sectional view illustrating the image forming apparatus 1000 with the front cover 102 fully opened.

As illustrated in FIGS. 5 through 7, the image forming apparatus 1000 according to Embodiment 1 includes the recovery container part 34 on an inner surface side of the front cover 102, which is a part included inside the apparatus body 100). By including the recovery container part 34 on the inner surface side of the front cover 102, when the front cover 102 is opened, the recovery container part 34 can be exposed to the outside. By contrast, when the front cover 102 is closed, the recovery container part 34 can be stored inside the apparatus body 100. With this configuration, maintenance work of the recovery container part 34 such as cleaning, removing the stored water droplet W, or checking whether or not the water droplet W is contained can be performed easily.

Figure 8:
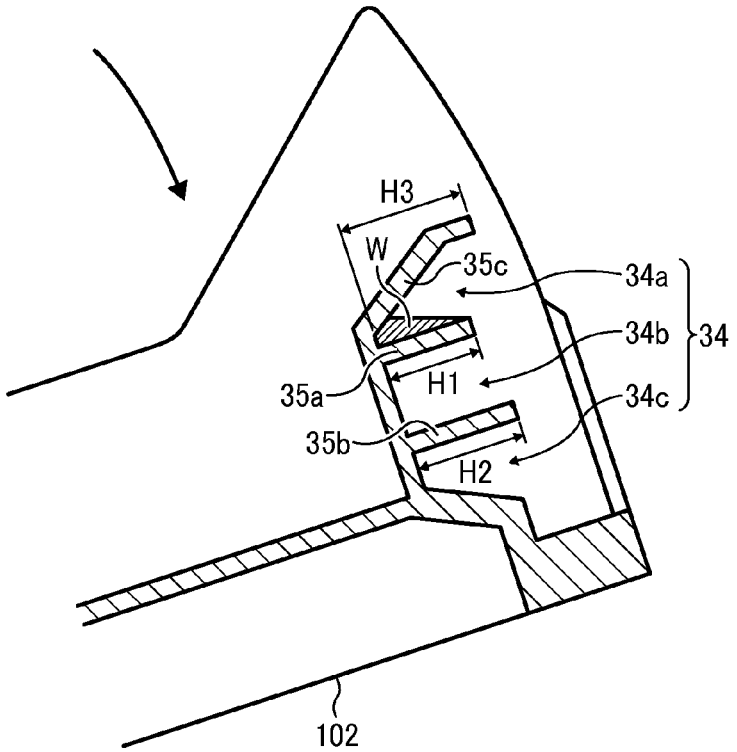
FIG. 8 is a diagram illustrating a position of a storage container while the front cover is opening.

In a case where the recovery container part 34 is disposed on the front cover 102, when the front cover 102 is opened with the water droplet W fully stored in the recovery container part 34, the stored water droplet W can spill from the recovery container part 34 due to vibration and/or inertia caused by opening/closing the front cover 102. Further, in a case where the front cover 102 pivots forward/upward about the rotation shaft 104 that is disposed at the lower end of the front cover 102 as described in Embodiment 1, as the front cover 102 opens, the water droplet W in the recovery container part 34 can drop in a direction in which the front cover 102 opens, as illustrated in FIG. 8.

To address this inconvenience, the recovery container part 34 according to Embodiment 1 includes multiple recovery containers 34*a*, 34*b*, and 34*c* aligned in an open/close direction of the front cover 102. With this configuration, even if the water droplet W stored in a recovery container of the recovery container part 34 spills due to vibration and/or inertia caused by opening/closing the front cover 102, another recovery container arranged adjacent to the recovery container can receive the spilled water droplet W, so that the water droplet W can be reduced or prevented from falling in the apparatus body 100 or onto the front cover 102.

Further, among the multiple recovery containers 34*a*, 34*b*, and 34*c* of the recovery container part 34 of Embodiment 1, a first recovery container 34*a* that is disposed at the extreme upstream side in an opening direction of the front cover 102 is selected as a container to which the water droplet W is guided, as illustrated in FIG. 3. According to this configuration, even if the water droplet W spills from the first recovery container 34*a*, an amount of spilled water droplet W can be received by a second recovery container 34*b* or a third recovery container 34*c* disposed downstream from the first recovery container 34*a* in the opening direction of the front cover 102.

Further, in Embodiment 1, sidewalls 35*a* and 35*b* are disposed adjacent to each other to function as partitions to separate the recovery containers 34*a*, 34*b*, and 34*c*. The sidewall 35*b* is disposed downstream from the sidewall 35*a* in the opening direction of the front cover 102. A height H2 of the sidewall 35*b* is set greater than a height H1 of the sidewall 35*a*, as illustrated in FIG. 8. This structure can easily cause the second recovery container 34*b* to receive the water droplet W that can fall from the first recovery container 34*a* when the front cover 102 is moved to open.

Further, in Embodiment 1, a sidewall 35*c* can be provided at an extreme downstream side in a closing direction of the front cover 102. To avoid dropping the water droplet W in the first recovery container 34*a* inside the apparatus body 100 when the front cover 102 is closed, a height H3 of the sidewall 35*c* is set greater than the heights H1 and H2 of the sidewalls 35*a* and 35*b* disposed upstream from the sidewall 35*c*, as illustrated in FIG. 8.

As described above in Embodiment 1, by aligning the first recovery container 34*a*, the second recovery container 34*b*, and the third recovery container 34*c* in the open/close direction of the front cover 102 and by setting the heights of the sidewalls 35*a*, 35*b*, and 35*c* as described above, the water droplet W can be reduced or prevented from spilling from the recovery container part 34 when the front cover 102 is opened or closed.

Further, in Embodiment 1, the front cover 102 is disposed to be substantially flat or parallel in a horizontal direction when the front cover 102 is fully opened, as illustrated in FIG. 7. However, the configuration of the front cover 102 is not limited thereto. For example, the front cover 102 can be stopped and held at a certain angle by a stopper or the like before the front cover 102 fully opens. Specifically, the front cover 102 is held open at a full opening position with the upper end of the front cover 102 opened upward or at a certain angle from the horizontal direction, as illustrated in FIG. 8. With this configuration, the leading ends of the sidewalls 35*a* and 35*b* separating the recovery containers 34*a*, 34*b*, and 34*c* are held to direct upwardly from the horizontal direction, and therefore spill of the water droplet W from the recovery containers 34*a* and 34*b* can be prevented.

Figure 9:
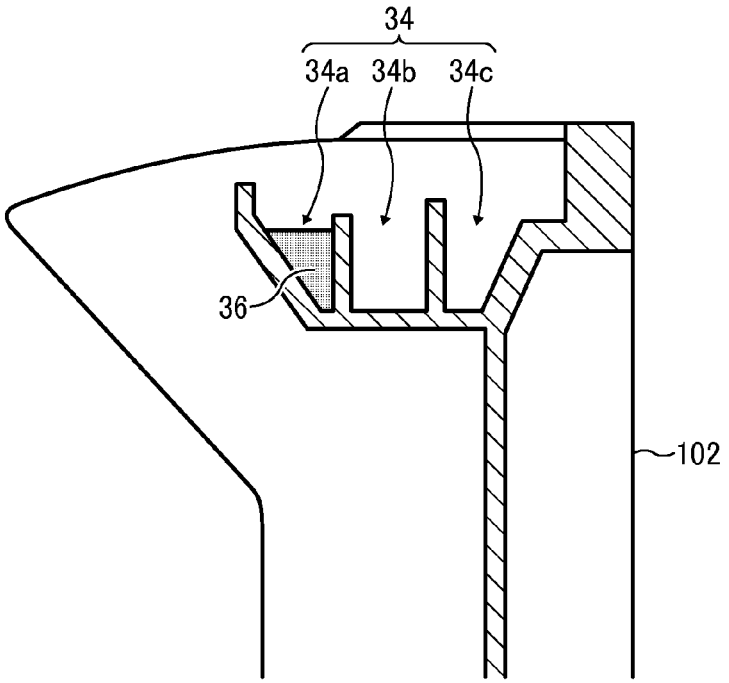
FIG. 9 is a diagram illustrating the storage container having a water absorbing member.

Further, by providing a water absorbing member 36 in the first recovery container 34*a* as illustrated in FIG. 9, the water absorbing member 36 can keep the water droplet W therein. Consequently, this configuration can further prevent spill of the water droplet W from the first recovery container 34*a* when the front cover 102 is opened or closed.

The water absorbing member 36 can be a sponge foam that has high moisture retention and can easily dehydrate by squeezing, thereby enhancing maintenance ability. Further, the water absorbing member 36 can be a disposable paper member to facilitate maintenance work.

Figure 10:
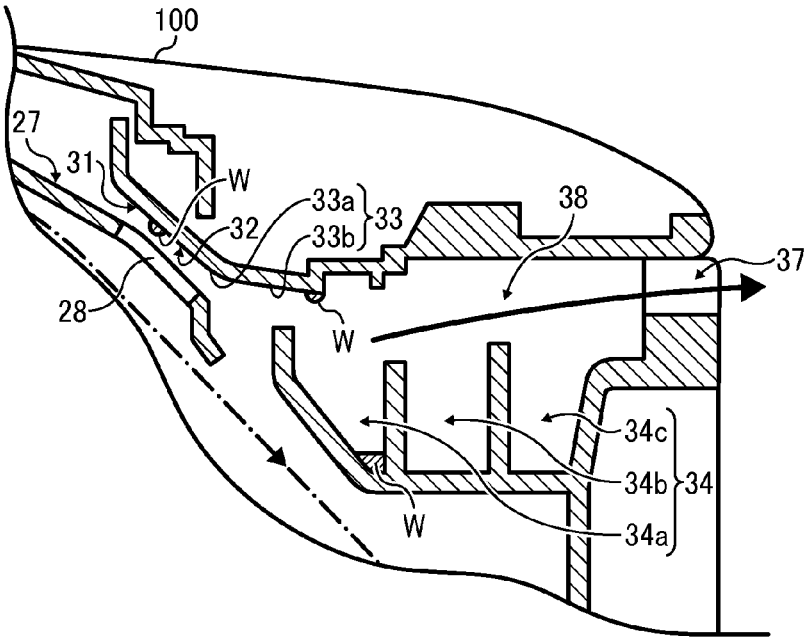
FIG. 10 is a diagram illustrating an apparatus body including an air-exhaust opening.

Further, as illustrated in FIG. 10, an air-exhaust port 37 is disposed on an upper part of the front cover 102 penetrating from inside to outside of the front cover 102, so that an airflow path 38 can be formed in a manner extending from the recovery container part 34 to the outside of the apparatus body 100 to communicate the recovery container part 34 and the outside of the apparatus body 100 therethrough. With this configuration, when the water droplet W contained in the recovery container part 34 evaporates again, the steam generated by the evaporation can be exhausted from the air-exhaust port 37 via the airflow path 38 using natural convection. Therefore, evaporation of the water droplet W in the recovery container part 34 can be facilitated, thereby reducing frequency of maintenance work of the recovery container part 34.

Figure 11:
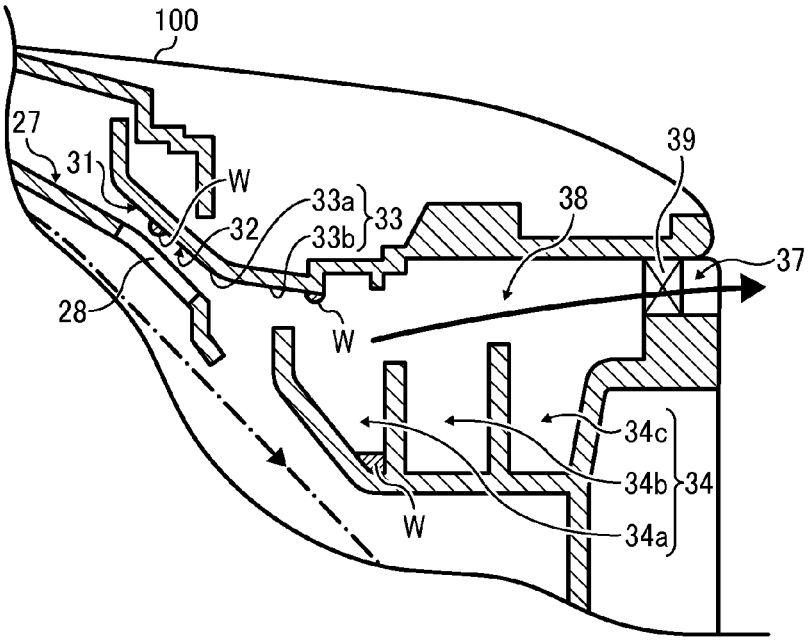
FIG. 11 is a diagram illustrating the apparatus body including an air-exhaust fan.

Further, as illustrated in FIG. 11, a fan 39 can be disposed in a vicinity of the air-exhaust port 37. The fan 39 functions as an airflow generator to positively generate airflow in the airflow path 38 from the recovery container part 34 to the outside of the apparatus body 100. With this configuration, evaporation of the water droplet W in the recovery container part 34 can be facilitated further. The fan 39 can be dedicated to the airflow from the air-exhaust port 37. However, by commonly using a different fan for another purpose, a reduction in cost can be achieved.

Further, evaporation of the water droplet W in the recovery container part 34 can be facilitated by performing machining with surface roughness to the inner surface of the recovery container part 34 or by disposing the recovery container part 34 in the vicinity of the fixing unit 17 to use heat generate from the fixing unit 17.

Figure 12:
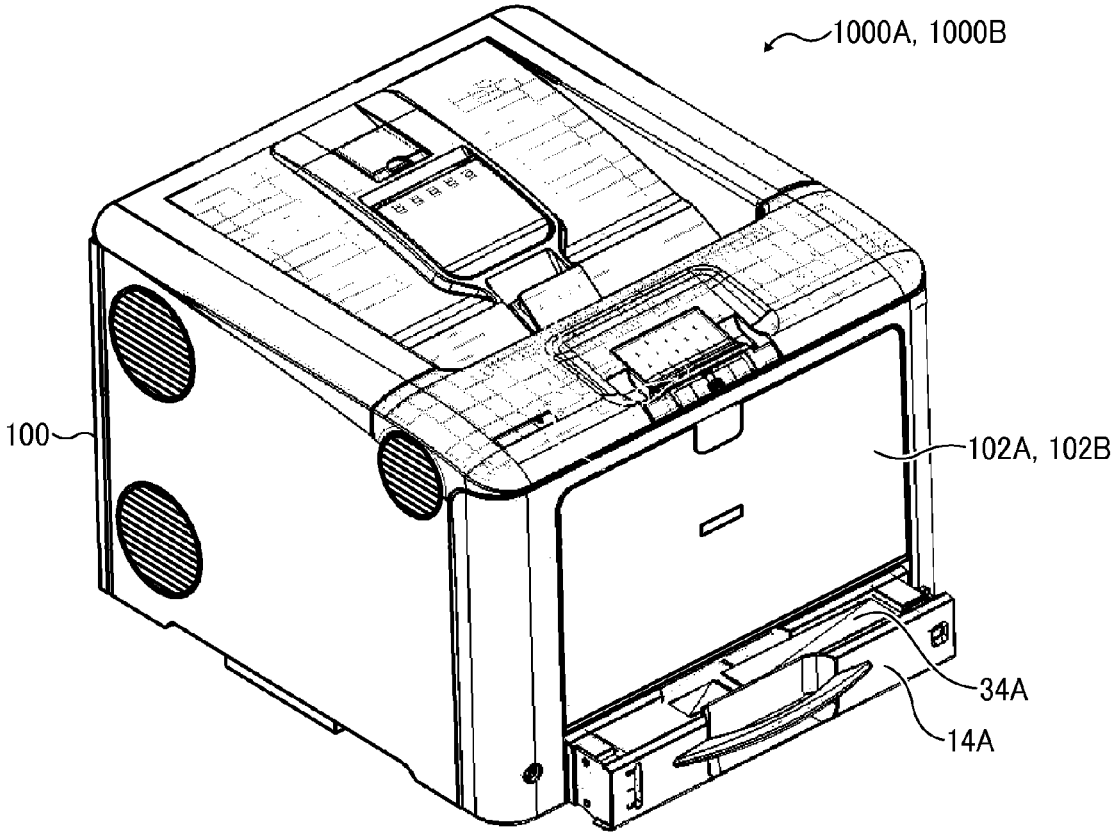
FIG. 12 is a perspective view illustrating an external appearance of an image forming apparatus according to Embodiments 2 and 3.
Figure 13:
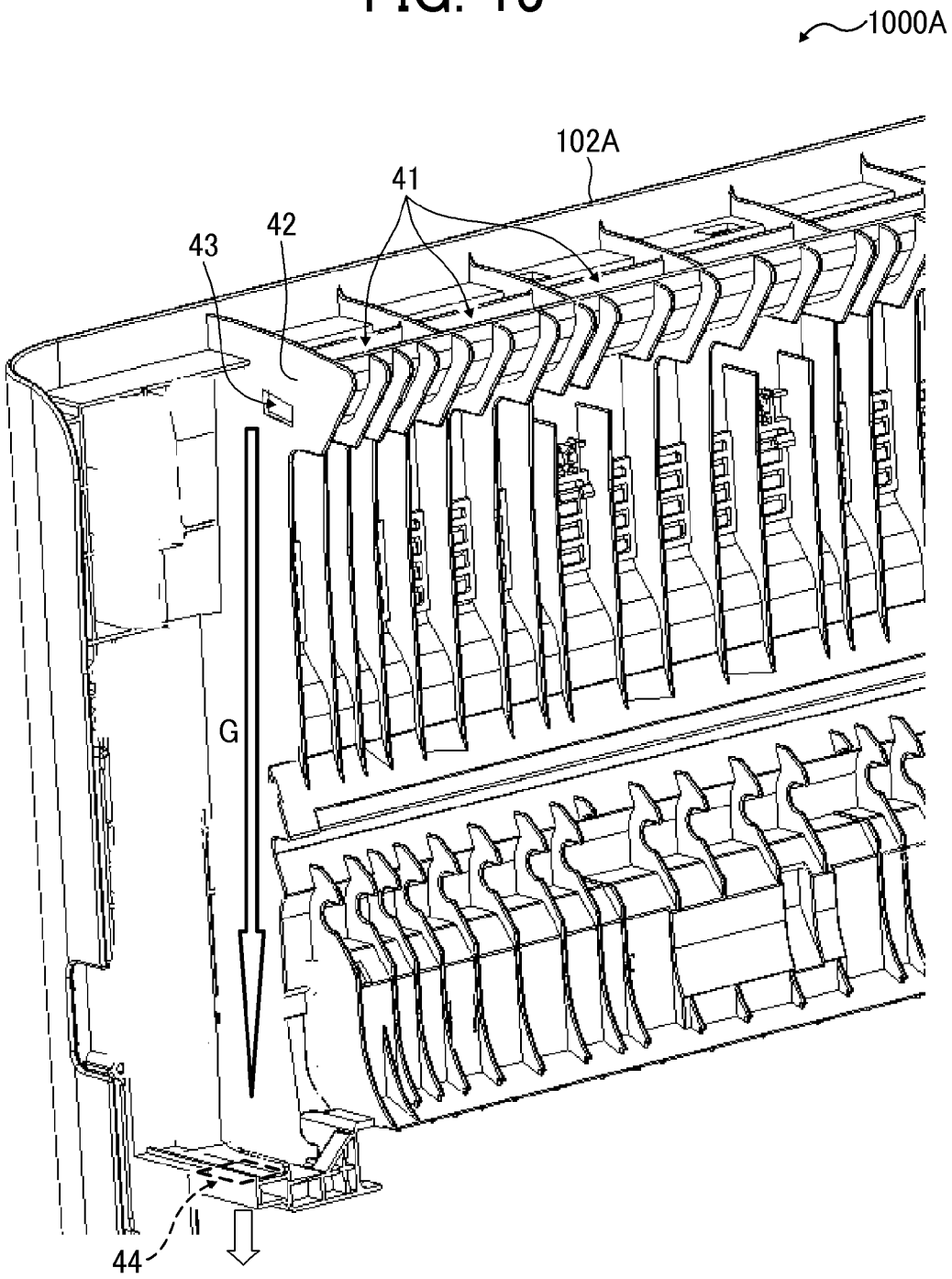
FIG. 13 is a diagram illustrating an inside of the front cover having a guide path to guide water droplet to the storage container according to Embodiment 2.

Next, a description is given of an image forming apparatus 1000A according to Embodiment 2 with reference to FIGS. 12 and 13. Elements or components of the image forming apparatus 1000A according to Embodiment 2 may be denoted by the same reference numerals as those of the image forming apparatus 1000 according to Embodiment 1 and the descriptions thereof are omitted or summarized.

As illustrated in FIG. 12, the image forming apparatus 1000A according to Embodiment 2 includes a sheet container 14A that has a recovery container part 34A to store water droplet therein. Specifically, the sheet container 14A in Embodiment 2 can also function as a manual operating unit. By pulling out or removing the sheet container 14A, the recovery container part 34A can be exposed to the outside, thereby facilitating maintenance work of the recovery container part 34A.

FIG. 13 is a diagram illustrating the inner side of a front cover 102A (on the side of the apparatus body 100) of the image forming apparatus 1000A indicating a guide path to guide the water droplet to the recovery container part 34A.

The front cover 102A includes receivers 41, a sidewall 42, an air-exhaust port 43, and a water inlet 44. Similar to Embodiment 1, the sheet container 14A according to Embodiment 2 has a configuration in which steam is dew-condensed on the condensation part 31 disposed at the upper front position of the apparatus body 100 to produce the water droplet. The water droplet is received by the receivers 41 provided on the upper part of the front cover 102A via the guide 32. The air-exhaust port 43 is formed on the sidewall 42 that forms the receivers 41. The water droplet in the receivers 41 is discharged through the air-exhaust port 43.

The sidewall 42 extends in a direction from the upper part to a lower part of the front cover 102A, so that the water droplet discharged through the air-exhaust port 43 is guided along the sidewall 42 with the aid of gravity downwardly in a direction indicated by arrow G in FIG. 13. Then, the water droplet is further guided from the water inlet 44 disposed at the lower part of the front cover 102A to the recovery container part 34A of the sheet container 14A.

Figure 14:
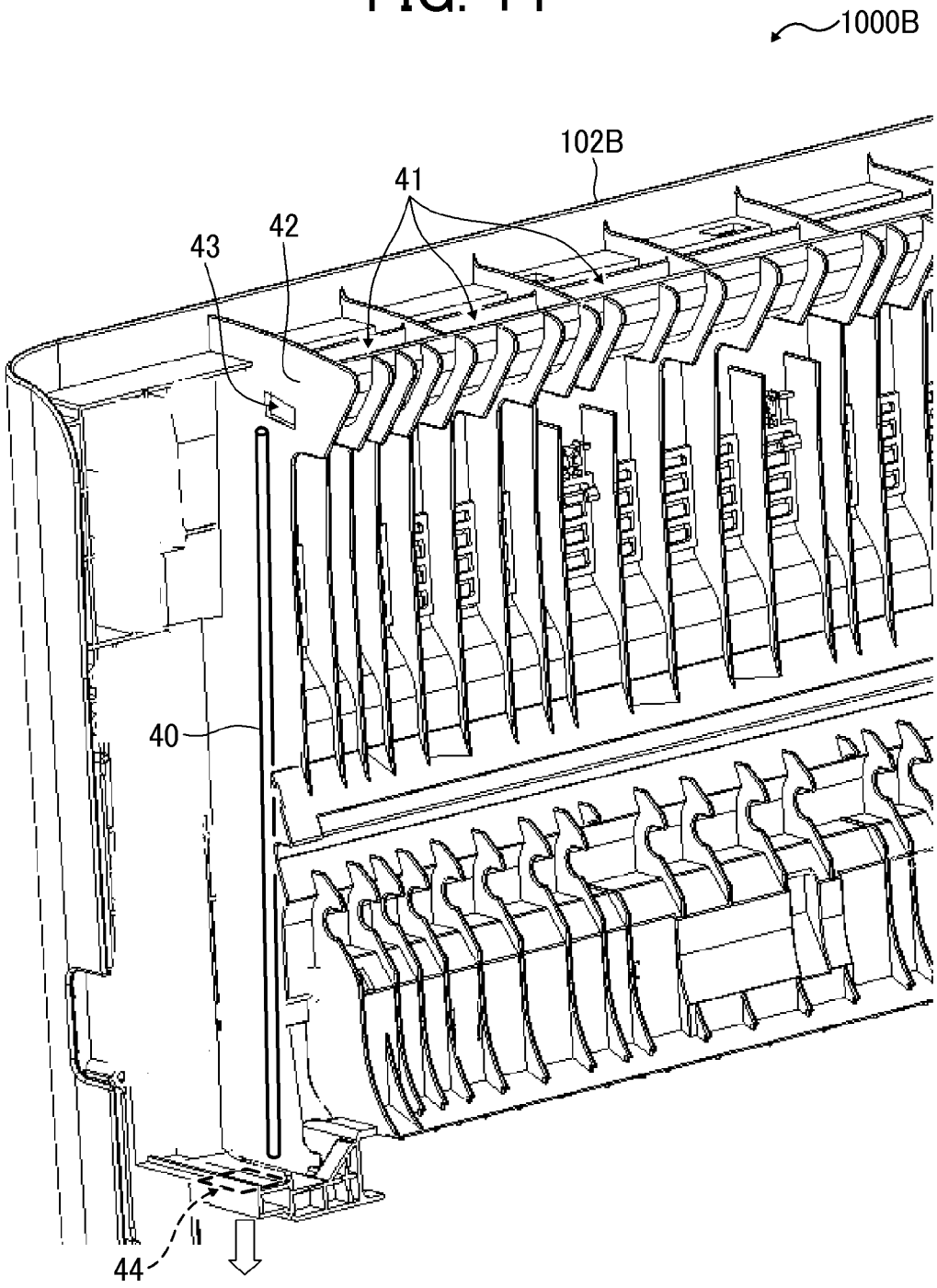
FIG. 14 is a diagram illustrating an inside of the front cover having a rib on a sidewall of the front cover to guide water droplet along the rib according to Embodiment 3.

Further, a description is given of an image forming apparatus 1000B according to Embodiment 3 with reference to FIGS. 12 and 14. Elements or components of the image forming apparatus 1000B according to Embodiment 3 may be denoted by the same reference numerals as those of the image forming apparatuses 1000 and 1000A according to Embodiments 1 and 2, and the descriptions thereof are omitted or summarized.

FIG. 14 is a diagram illustrating the inner side of a front cover 102A of the image forming apparatus 1000B having a rib 40 on the sidewall 42 of the front cover 102B to guide water droplet along the rib 40 according to Embodiment 3.

As illustrated in FIG. 14, the rib 40 functioning as a guide extending from the air-exhaust port 43 to the water inlet 44 on the sidewall 42 can be provided to the front cover 102B, so as to guide the water droplet to the water inlet 44 along the rib 40.

Further, as illustrated in FIG. 12, the image forming apparatus 1000B according to Embodiment 3 includes the sheet container 14A that can also function as a manual operating unit. Similar to Embodiment 3, by pulling out or removing the sheet container 14A of the image forming apparatus 1000B, the recovery container part 34A can be exposed to the outside, thereby facilitating maintenance work of the recovery container part 34A.

Although particular embodiments have been described herein, it will be appreciated that the invention is not limited thereto and that various modifications and additions thereto may be made without departing from the scope of the invention.

In the above-described embodiments, the recovery container part (34, 34A) is disposed on the front cover (102, 102A, 102B) or the sheet container (14, 14A). However, the configurations according to Embodiments 1, 2, and 3 are not limited to the present invention. For example, the recovery container part (34, 34A) can be disposed on the top cover 101 illustrated in FIG. 2 or a different member or unit that can open/close, be removed/inserted, or be detached/attached with respect to the apparatus body 100. Specifically, in the manual operating unit (i.e., the front cover 102, 102A, 102B) having the configurations according to Embodiments 1, 2, and 3, at least a part of the recovery container part (34, 34A) is exposed to the outside of the apparatus body and a part of the manual operating unit that is included inside the apparatus body can be exposed to the outside by manually operating from the outside.

By disposing the recovery container part at the part of the manual operating unit included inside the apparatus body, the recovery container part disposed on the manual operating unit can be exposed to the outside the apparatus body and facilitate maintenance work thereof. Since the maintenance work of the recovery container part can be facilitated, workload of a user or an operator can be reduced, thereby achieving a highly operable image forming apparatus.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus comprising:

an apparatus body;

a manual operating unit, partially included inside the apparatus body and partially exposed outside the apparatus body for manual operation; and a container, disposed on an inner surface of the manual operating unit inside the apparatus body, to contain at least one water droplet generated in the apparatus body.

2. The image forming apparatus according to claim 1, wherein the manual operating unit includes a cover unit pivotably disposed and closeable with respect to the apparatus body.

3. The image forming apparatus according to claim 2, wherein the cover unit comprises a rotation shaft extending in a horizontal direction, about which the cover unit is pivotable and closeable with respect to the apparatus body, and wherein the container includes multiple containers aligned in an open or close direction of the cover unit.

4. The image forming apparatus according to claim 3, wherein the rotation shaft is disposed at a relatively lower part of the cover unit.

5. The image forming apparatus according to claim 3, further comprising a guide to guide the at least one water droplet generated on the apparatus body to the container.

6. The image forming apparatus according to claim 3, wherein the container further comprises multiple sidewalls to partition the multiple containers, and wherein a height of a downstream sidewall of the multiple sidewalls disposed at a downstream side in an opening direction of the cover unit is set to be relatively greater than a height of an upstream sidewall of the multiple sidewalls disposed upstream from the downstream sidewall in the opening direction of the cover unit.

7. The image forming apparatus according to claim 3, wherein the container further comprises multiple sidewalls to partition the multiple containers, and wherein a height of an extreme downstream sidewall of the multiple sidewalls in a closing direction of the cover unit is set to be relatively greater than a height of a different upstream sidewall of the multiple sidewalls disposed upstream from the extreme downstream sidewall in the closing direction of the cover unit.

8. The image forming apparatus according to claim 2, wherein the cover unit is provided to a front side of the apparatus body.

9. The image forming apparatus according to claim 1, further comprising:

a recording medium conveying guide disposed inside the apparatus body and including a guide side surface and a back side surface; and a through-opening through which the recording medium conveying guide penetrates from the guide side surface to the back side surface.

10. The image forming apparatus according to claim 1, wherein the container includes a water absorbing member.

11. The image forming apparatus according to claim 1, wherein an airflow path exists in the apparatus body, extending from the container to the outside of the apparatus body, to communicate the container and the outside of the apparatus body.

12. The image forming apparatus according to claim 11, further comprising an airflow generator to generate airflow in the airflow path from the container to the outside of the apparatus body.

13. The image forming apparatus according to claim 1, wherein the manual operating unit corresponds to a recording media container removably inserted insertable with respect to the apparatus body.

14. The image forming of claim 1, further comprising a condensation part, to condense moisture generated in the apparatus body.

15. An image forming apparatus comprising:

an apparatus body;

a manual operating unit, partially included inside the apparatus body and partially exposed outside the apparatus body for manual operation; and a container, disposed inside the apparatus body, to hold moisture generated in the apparatus body.

16. The image forming apparatus of claim 15, wherein the container is disposed on an inner surface of the manual operating unit, inside the apparatus body.

17. The image forming apparatus of claim 15, further comprising a guide to guide the moisture generated on the apparatus body to the container.

18. The image forming apparatus of claim 15, further comprising a condensation part, to condense moisture generated in the apparatus body.

19. The image forming apparatus of claim 18, further comprising a guide to guide the moisture generated from the condensation part to the container.

* * * * *